US005384517A

United States Patent [19]

Uno

[11] Patent Number: 5,384,517

[45] Date of Patent: Jan. 24, 1995

[54] ELECTROLUMINESCENT ELEMENT INCLUDING A THIN-FILM TRANSISTOR FOR CHARGE CONTROL

[75] Inventor: Yasuhiro Uno, Kanagawa, Japan

[73] Assignee: Fuji Xerox Co., Ltd., Tokyo, Japan

[21] Appl. No.: 897,792

[22] Filed: Jun. 12, 1992

[30] Foreign Application Priority Data

Jun. 14, 1991 [JP] Japan ..... 3-169120

[51] Int. Cl.[6] ..... G09G 3/10

[52] U.S. Cl. ..... 315/169.3; 315/169.1; 257/9; 257/13; 257/79; 257/94; 313/504; 313/499; 313/509; 313/506

[58] Field of Search ..... 315/169.1, 169.3; 257/9, 13, 79, 94; 313/504, 499, 509, 506

[56] References Cited

U.S. PATENT DOCUMENTS

| | | | |
|---|---|---|---|
| 4,594,282 | 6/1986 | Kawaguchi et al. | 428/216 |
| 4,672,266 | 6/1987 | Niguchi et al. | 313/509 |
| 4,721,631 | 1/1988 | Endo et al. | 427/66 |
| 4,877,995 | 10/1989 | Thioulouse et al. | 315/169.3 |
| 4,947,081 | 8/1990 | Ohiwa et al. | 313/509 |
| 4,975,338 | 12/1990 | Kageyama et al. | 428/690 |
| 5,003,221 | 3/1991 | Shimizu | 313/509 |
| 5,059,862 | 10/1991 | Van Slyke et al. | 313/504 |

OTHER PUBLICATIONS

An AC Thin-Film Display with Pr-Mn Oxide Black Dielectric Material, Matsuoka et al., IEEE Transactions On Electron Devices, vol. ED-33 No. 9, Sep. 1986.

*Primary Examiner*—Robert J. Pascal
*Assistant Examiner*—Reginald A. Ratliff
*Attorney, Agent, or Firm*—Finnegan, Henderson, Farabow, Garrett & Dunner

[57] ABSTRACT

An electroluminescent element comprising a first electrode, a second electrode, a luminescent layer located between the first electrode and the second electrode and emitting light by application of the AC voltage to the first electrode and the second electrode, a first dielectric layer located between the first electrode and the luminescent layer, a second dielectric layer located between the second electrode and the luminescent layer, and a charge control layer located between the luminescent layer and at least one of the first and second dielectric layers and controlling stored charge accordance with control voltage.

10 Claims, 7 Drawing Sheets

ELECTROLUMINESCENT ELEMENT INCLUDING A THIN-FILM TRANSISTOR FOR CHARGE CONTROL

BACKGROUND OF THE INVENTION

1. Field of the Invention

The present invention relates to an electroluminescent element which emits light by applying a voltage to electrodes formed on upper and lower sides of a luminescent layer, and in particular relates to the structure of an electroluminescent element containing a switching element.

2. Discussion of the Related Art

An electroluminescent element has luminescent materials in a luminescent layer to which an electric field is applied which emits light by excitation when accelerated free electrons inside the luminescent layer collide with them.

FIG. 12 is a cross-sectional view of a conventional electroluminescent element wherein a lower electrode 102, a first dielectric layer 103, a luminescent layer 104, a second dielectric layer 106 and an upper electrode 107 are formed on an insulating substrate 101 in this order. The luminescent layer 104 contains luminescent materials in a matrix material and is entirely surrounded by the first dielectric layer and the second dielectric layer.

In the electroluminescent element which has a structure such as described above, rare earth metal fluorides are used as the luminescent materials. When a high electric field (for example, 2.0 MV/cm) is applied between the upper electrode 107 and the lower electrode 102, electrons jump out from the interface between the first dielectric layer 103 and the luminescent layer 104 or between the second dielectric layer 106 and the luminescent layer 104 into the luminescent layer 104, and are energized by being accelerated in the high electric field. These high-energy electrons collide with the luminescent materials contained in the luminescent layer 104 and excite the luminescent materials. The light emission arises when the excited luminescent materials return to their ground state.

Using a film forming method such as vapor deposition or sputtering, a large number of electroluminescent elements as described above can be formed on a large substrate to form a flat panel display.

An electroluminescent flat panel display has a plurality of electroluminescent elements arranged over the surface of a substrate. The lower and upper electrodes of these electroluminescent elements are linear and orthogonal, forming a matrix structure. The electroluminescent flat panel display also has a plurality of driver circuits for the electroluminescent elements. Supposing m represents the number of linear lower electrodes and n represents the number of linear upper electrodes, then the electroluminescent flat panel display requires (m+n) driver circuits in total.

When an AC voltage is selectively applied to the lower and upper electrodes by the driver circuits, the luminescent layer at the points of intersection of the electrode matrix to which the AC voltage is applied emits light, and accordingly, the required image can be displayed as a combination of the electroluminescent elements which emit light and those which do not.

However, to generate the high electric field capable to cause the light emission in the electroluminescent element mentioned above, a high voltage (for example, 200 V) must be applied to the upper and lower electrodes. Therefore, the driver circuits in the electroluminescent flat panel display have to be able to switch 200 V AC on and off, and the driver integrated circuits functioning as switching elements must be able to withstand this high voltage.

Driver integrated circuits able to withstand high voltages are expensive because of the particular process of manufacturing. In consequence, the problem occurs that the electroluminescent flat panel display is also expensive.

When electroluminescent elements arranged in a matrix are used for the display, light emission at each point occurs only once or twice during each frame in which the linear lower and upper electrodes are selected sequentially to scan all the picture elements. Therefore, the electroluminescent materials which emit red or blue light cannot be used as the emitting elements for a display because of their low intensity of light emission.

SUMMARY OF THE INVENTION

The present invention has been made in view of the above circumstances and has as an object to provide an electroluminescent element capable of controlling light emission at a low voltage and needing no expensive driver integrated circuits.

A further object of the present invention is to provide a electroluminescent element capable of using materials with a low intensity of light emission as the luminescent layer for an emitting device in a electroluminescent flat panel display.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the electroluminescent element of this invention comprises a first electrode, a second electrode, a luminescent layer located between the first electrode and the second electrode, a first dielectric layer located between the first electrode and the luminescent layer, a second dielectric layer located between the second electrode and the luminescent layer and a charge control layer located between the luminescent layer and at least one of the first and second dielectric layers and controlling stored charge in accordance with control voltage. Further, a thin insulating layer may be interposed between the charge control layer and the luminescent layer in order to prevent reaction caused by contact of these two layers.

For example, amorphous silicon may form the above-mentioned charge control layer. The charge control layer may also consist of group II–VI semiconductors such as CdS or CdSe.

The matrix material of the luminescent layer of the above-mentioned electroluminescent element contains rare earth fluorides or other materials as luminescent materials.

Common materials used for the dielectric layer or electrode of the conventional electroluminescent element are also used for the first and second dielectric layers and electrodes of the electroluminescent element according to the present invention.

FIG. 2 shows an example of an equivalent circuit of an electroluminescent element with the above-mentioned structure. This equivalent circuit performs the control of light emission as follows.

An AC power supply applies a pulse signal, such as is shown in FIG. 3, between the lower electrode and the upper electrode, and a data signal controlling light emission of the electroluminescent element is input to the gate electrode and the source electrode of the built-in thin-film transistor. That is, the semiconductor layer interposed between the luminescent layer and the dielectric layer functions as the drain electrode of the thin-film transistor. In order to cause the electroluminescent element not to emit light, the potential of the source electrode of the thin-film transistor must be higher than the potential of the semiconductor layer in the electric field between the upper electrode and the lower electrode (i.e., the potential of the drain electrode) and the thin-film transistor must be on. Under this condition, electrons collected in the semiconductor layer forming the drain electrode move to the source electrode, and then, if the thin-film transistor is turned off, since the luminescent layer is depleted of electrons, even when the AC pulse signal is applied between the upper and lower electrodes, the electroluminescent element does not emit light. On the other hand, light emission occurs when the potential of the source electrode is lower than that of the drain electrode and the thin-film transistor is turned on, because the electrons move from the source electrode to the semiconductor layer acting as the drain electrode and into the luminescent layer, and are then excited by the voltage applied between the upper and lower electrodes, and collide with the luminescent materials. If the thin-film transistor is turned off in this state, the electroluminescent element continues emitting light as the AC pulse voltage is applied to the upper and lower electrodes even when no data signals are input to the gate electrode and the source electrode.

As described above, light emission of the electroluminescent element can be controlled at a low voltage by the signals input to the gate electrode and the source electrode which are independent from the AC voltage applied between the upper and lower electrodes because of the built-in thin-film transistor. Consequently, the driver integrated circuit devices functioning as the switching elements of the driver circuits do not need to be able to withstand a high voltage.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

The embodiments of an electroluminescent element according to the present invention will now be described in detail based on the drawings.

Figure 1:
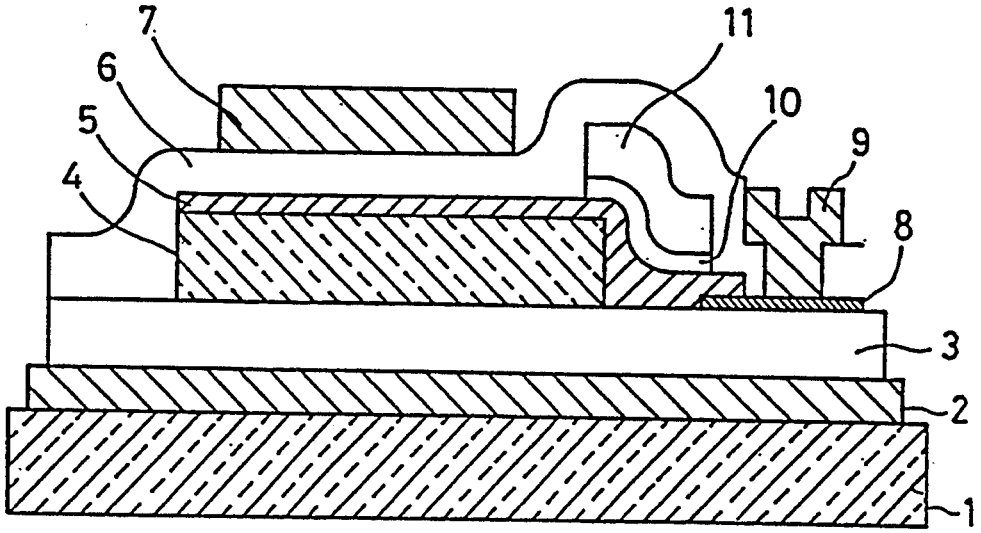
FIG. 1 is a cross-sectional view of a first embodiment of the electroluminescent element according to the present invention.

FIG. 1 is a cross-sectional view showing a first embodiment of the electroluminescent element according to the present invention. The electroluminescent element comprises a glass substrate 1, on which a transparent lower electrode 2, a first dielectric layer 3, a luminescent layer 4, a semiconductor layer 5, a second dielectric layer 6, an upper electrode 7 are formed in this order. The semiconductor layer 5 extends to a portion where the luminescent layer is not formed and the end of the extended side is connected to a source contact 8 comprising a silicon layer doped with a large quantity of impurity such as phosphorus (an n+ layer), and the source contact 8 is further connected to a source electrode 9 made of metal such as aluminum. The portion of the semiconductor layer 5 which extends beyond the luminescent layer 4 acts effectively as a drain electrode. A gate insulating film 10 is interposed between the drain electrode portion and the source electrode, and thereon a gate electrode 11 is formed.

Regarding to the above description, a film comprising transparent polymer material or the like can be substituted for glass as the insulating substrate.

For the first and second dielectric layer, dielectric materials which have dielectric constant $\epsilon$ ranging from 6 to 200 such as $Y_2O_3$, $Si_3N_4$, $Sm_2O_3$, $Ta_2O_3$ or $BaTiO_3$ can be used.

In order to form the electrodes, materials for transparent electrodes such as $In_2O_3$, $SnO_2$ or ITO (indium tin oxide), and some metals, for example, Ta, Mo, W, Al, Au or Cu can be used.

As the semiconductor layer for controlling stored charge, amorphous silicon, CdS, CdSe, $WO_x$ ($WO_3$), $TaN_x$ or $TiN_x$ can be used.

The luminescent layer 4 described above is formed by adding rare earth fluoride as luminescent material to a matrix material. ZnS, ZnSe, SrS, CaS and the like may be used as the fluorescent matrix material composing the luminescent layer, and most preferably, ZnS. As an activator for the luminescent materials, Cu, Mn, $TbF_3$, $PrF_3$, $DyF_3$, Ce, Te or Eu may be used. Therefore, the luminescent layer may comprise ZnS:Cu,Cl, ZnS:Cu-,Al, ZnS:Mn,Cu, Zn(S,Se):Cu,I, SrS:Ce, CaS:Ce, ZnS:Te,Mn or CaS:Eu. These materials can be made by sintering the components of the materials in a gas atmosphere.

Because an electroluminescent element with a structure as described above has the semiconductor layer formed on one side of the luminescent layer like the thin-film electroluminescent element disclosed by U.S. Pat. No. 5,164,799, an interface between the luminescent layer 4 and the semiconductor layer 5 can be formed at higher location. Further, since a large number of free electrons can be present at the interface, the luminescent layer 4 has a lower threshold value of the electric field for emitting light in comparison with conventional elements.

An electroluminescent element using a rare earth fluoride as the luminescent material without a semiconductor layer or the like between the luminescent layer 4 and the dielectric layer 6 requires the application of an electric field of about 2.0 MV/cm to the luminescent layer 4, whereas the electroluminescent element according to the present invention is able to make its luminescent layer 4 emit light by application of an AC voltage not exceeding about 0.8 MV/cm.

In order to apply an electric field of the threshold value for light emission of about 0.8 MV/cm to the luminescent layer 4, it is necessary to apply an AC pulse signal of about ±100 V to the lower electrode 2 and the upper electrode 7. The voltage of the AC pulse signal of ±100 V is divided among the first dielectric layer 3, the luminescent layer 4, the semiconductor layer 5 and the second dielectric layer 6, and thus the AC pulse signal applied to the semiconductor layer 5 acting as the drain electrode of the thin-film transistor is about ±30 V.

The control of light emission or non-emission in the electroluminescent element mentioned above is now described based on FIGS. 2 and 3.

Figure 2:
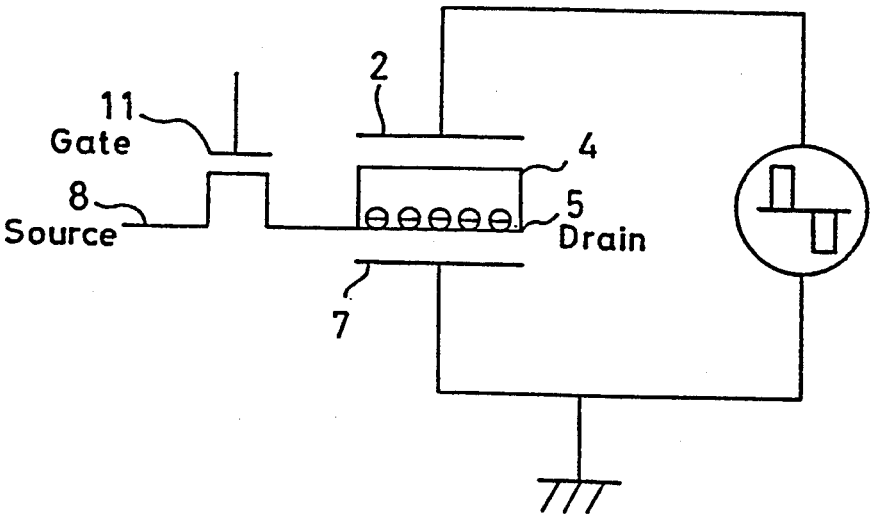
FIG. 2 is a view showing an equivalent circuit of the first embodiment described above.

FIG. 2 shows the equivalent circuit of the above-mentioned electroluminescent element.

Figures 3A, 3B, 3C:
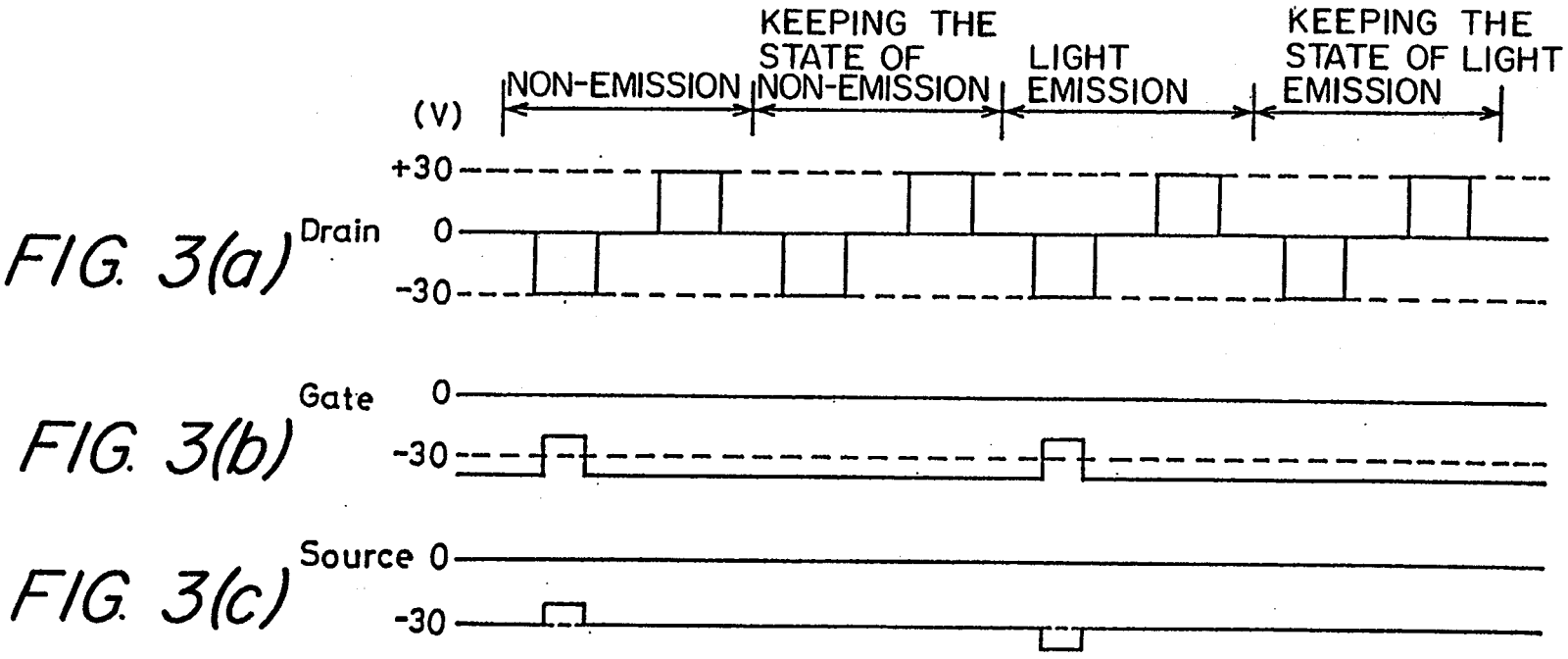
FIGS. 3(*a*)–3(*c*) are timing diagrams showing examples of waveforms of driving voltages in the first embodiment described below.

Suppose that a ±30 V AC pulse signal is applied to the drain electrode (semiconductor layer) 5 as shown in FIG. 3 (a), and that the AC pulse voltage applied to the source electrode 9 is −30 V which is the same as the minimum value of the AC pulse voltage applied to the drain electrode 5 as shown in FIG. 3(*c*). Further, as shown in FIG. 3(*b*), the AC pulse voltage applied to the gate electrode 11 is arranged to be −20 V when the signals are input and −40 V when the signals are not input.

First the control of the electroluminescent element so as not to emit light is described.

When the voltage of the drain electrode 5 is negative, the voltage of the source electrode 9 is arranged to be −20 V, which is 10 V higher than the voltage of the drain electrode 5, and the voltage of the gate electrode 11 is arranged to be also −20 V to turn the thin-film transistor on. The electrons first move inside the luminescent layer 4 toward the drain electrode 5, and then move into the source electrode because the voltage of the source electrode 9 is higher than that of the drain electrode 11 when the thin-film transistor is on. After that, even if the thin-film transistor is turned off, and the voltage of the source electrode returns to −30 V, and an AC pulse of reverse polarity is applied to the electroluminescent element, the luminescent layer 4 does not emit light because it is depleted of electrons. Even though the AC pulse signal is applied continuously, the electroluminescent element continues not to emit light as long as no data signals are input to the gate.

Next, the light emitting state of the electroluminescent element is described. In order to turn the thin-film transistor on, the voltage of the drain electrode 5 is made negative, the voltage of the source electrode 9 is arranged to be −40 V which is 10 V lower than the potential of the drain electrode and the voltage of the gate electrode is arranged to be −20 V which is 20 V higher than the potential of the source electrode. The electrons then move to the drain electrode from the source electrode because the voltage of the drain electrode 5 is higher than that of the source electrode 9. The electrons having entered the drain electrode 5 move into the luminescent layer 4 toward the upper electrode because of the electric field applied to the luminescent layer 4. Then, inside the luminescent layer 4 electrons collide with the luminescent materials and thereby the luminescent materials are excited and electroluminescence occurs. After that the data signals are not input to the gate, and the voltage of the source electrode returns to −30 V, but as the AC pulse signal continues to be applied, the electroluminescent element maintains light emission even though the thin-film transistor is off.

In this way, the electroluminescent element according to the present invention is able to control the light emission at a low voltage, for example, about 40 V.

Figure 4:
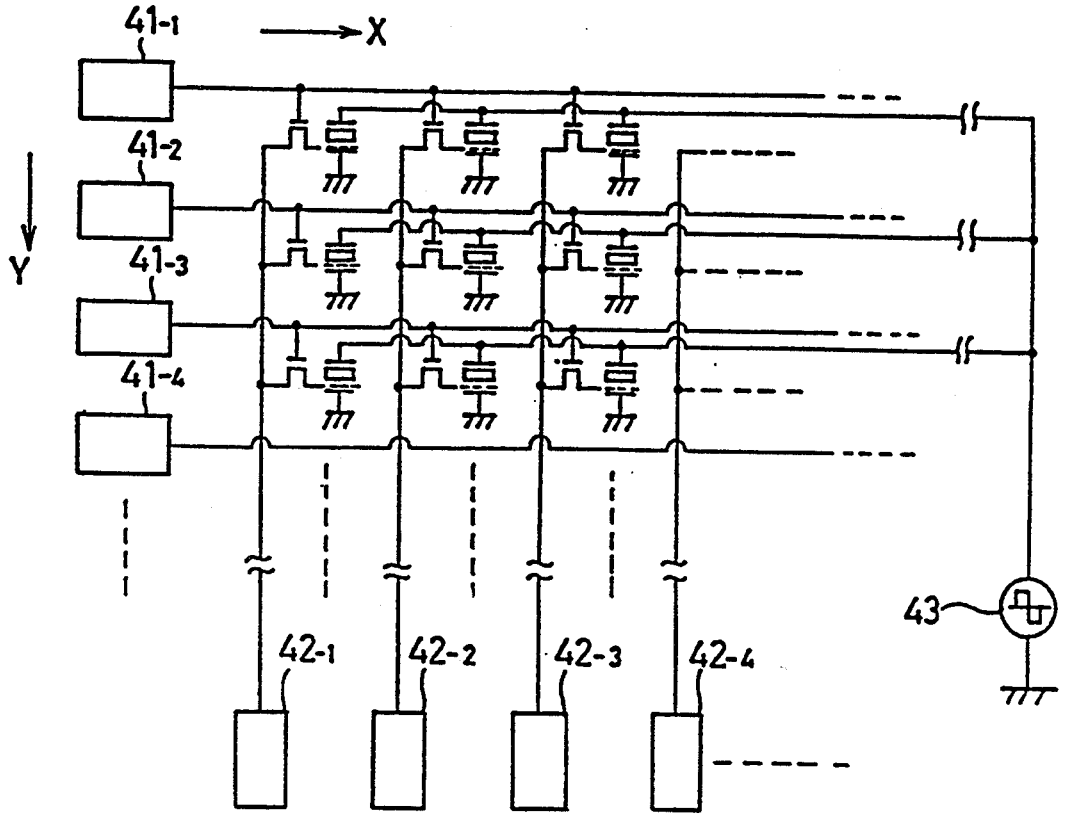
FIG. 4 shows an equivalent circuit of an electroluminescent display formed by arranging the electroluminescent elements of the first embodiment in a matrix.

An equivalent circuit of the electroluminescent flat panel display on which the electroluminescent elements containing thin-film transistors are arranged in matrix is shown in FIG. 4. The gate electrodes of the electroluminescent elements arranged in the x-direction in FIG. 4 are connected to identical driver circuits $\mathbf{41}_{-1}$ to $\mathbf{41}_{-n}$ and the source electrodes of the electroluminescent elements in the y-direction are connected to similar driver circuits $\mathbf{42}_{-1}$ to $\mathbf{42}_{-n}$.

Data signals are selectively output from the driver circuits of the gate electrodes and those of the source electrodes, and then the electroluminescent elements on the intersection points of the data signals output from the driver circuits of the gate electrodes and those of the source electrodes are selected and controlled to emit light or not.

On the other hand, the AC pulse signal from an AC power supply 43 is applied to the upper and lower electrodes formed on both sides of the luminescent layer 4 independently of the scan operation controlling the source electrodes and the gate electrodes.

Since after the electroluminescent element is selected and switched to emit light or not, the gate is turned off and that condition is maintained until the next selection, when the light emission is enabled, it can occur continuously as the AC pulse signal is applied to the upper and lower electrodes.

Consequently, the electroluminescent flat panel display is able to provide sufficient intensity of light emission even using electroluminescent materials with low light emission intensities.

Next, a method for realizing a gray-level display in the electroluminescent flat panel display driven as mentioned above, using the electroluminescent element according to the present invention is described.

In order to cause the light emission of the electroluminescent element, the voltage of the source electrode 9 is determined to be lower than that of the drain electrode when the drain electrode potential is negative. In this case the value of the source electrode voltage is arranged to vary continuously within a range from −30 V to −40 V; accordingly, the number of the electrons moving to the drain from the source varies continuously and thus the number of free electrons inside the luminescent layer is controlled. As a result, the intensity of the light emission of the luminescent layer can be varied continuously. Thus, in the electro-luminescent element according to the present invention, a gray-level display can be realized by changing the voltage of the source electrode during the light emission.

Figure 5:
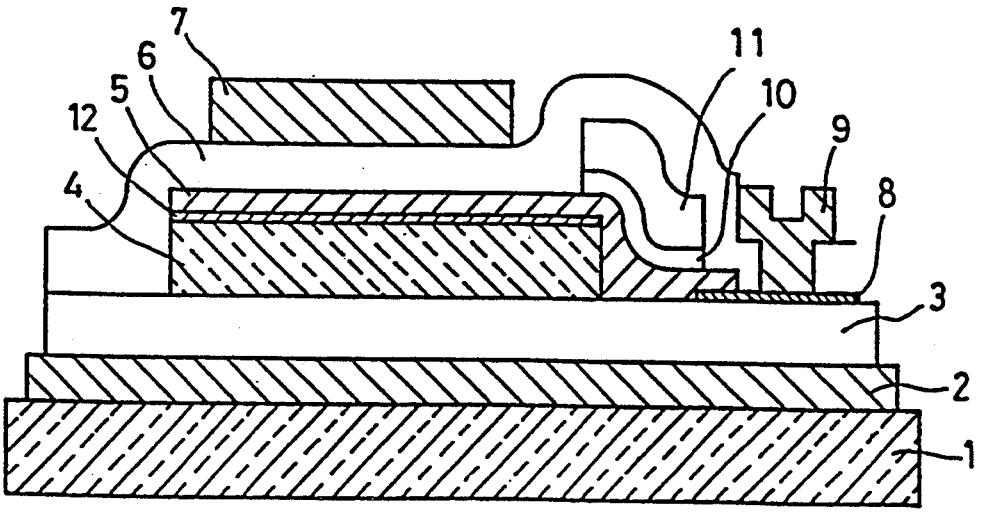
FIG. 5 is a cross-sectional view of a second embodiment of the electroluminescent element according to the present invention.

FIG. 5 is a cross-sectional view showing a second embodiment of the electroluminescent element according to the present invention.

An insulating layer 12 of $SiO_2$ of a thickness approximately 0.005 nm is interposed between the luminescent layer 4 and the semiconductor layer 5 of the electroluminescent element of this embodiment. The other portions have the same structure as those of the electroluminescent element of the first embodiment as shown in FIG. 1.

In the above-mentioned electroluminescent element, the luminescent layer 4 and the semiconductor layer 5 do not contact directly because of the insulating layer 12, and therefore, deterioration of the luminescent layer 4 and the semiconductor layer 5 caused by reaction at the interface of these two layers is prevented and the reliability of light emission control by the semiconductor layer 5 in the electroluminescent element is improved.

However, the insulating layer 12 does not prevent the operation of the electroluminescent element according to the present invention because the electrons can tunnel through the insulating layer 12 since its thickness is only about 0.005 nm.

An example method of manufacturing the electroluminescent element shown in FIG. 1 or FIG. 5 is described next.

(1) A transparent conductive film of indium tin oxide is deposited on a glass substrate 1 by electron-beam deposition or sputtering and is formed into the transparent lower electrode 2 by photolitho-etching.

(2) The first dielectric layer comprising SiN or the like is deposited by sputtering or plasma chemical vapor deposition.

(3) An n+ layer used as a source contact is deposited by plasma chemical vapor deposition and is formed into the source contact 8 by photolitho-etching.

(4) The luminescent layer comprising $ZnS;TbF_3$ or the like is deposited by electron-beam deposition or sputtering.

(5) Before the process of photolitho-etching, the insulating layer of $SiO_2$ or the like is deposited to a thickness of about 0.005 nm as a tunneling layer by sputtering or plasma chemical vapor deposition.

(6) The tunneling layer 12 is first patterned upon the form of the luminescent layer by photolitho-etching.

(7) The luminescent layer is next patterned in the same form as the tunnel layer 12.

(8) The semiconductor layer comprising amorphous silicon or the like and the gate insulating film of SiN are successively deposited by plasma chemical deposition, electron-beam deposition, sputtering or resistance heating deposition. Next by photolitho-etching, the gate insulating film 10 is first formed and then the semiconductor layer 5 is formed.

(9) A metal such as tantalum is deposited and formed into the gate electrode 11 by photolitho-etching.

(10) The second dielectric layer 6 comprising SiN or the like is deposited by sputtering or plasma chemical vapor deposition.

(11) The electrodes of aluminum or the like are deposited by electron-beam deposition or sputtering and formed into the upper electrode 7 and the source electrode 9 by photolitho-etching. Thus the electroluminescent element is completed.

To fabricate an element which does not have the insulating layer 12 between the luminescent layer 4 and the semiconductor layer 5 as shown in FIG. 1, steps (5) and (6) of the above-mentioned manufacturing method are omitted.

Figure 6:
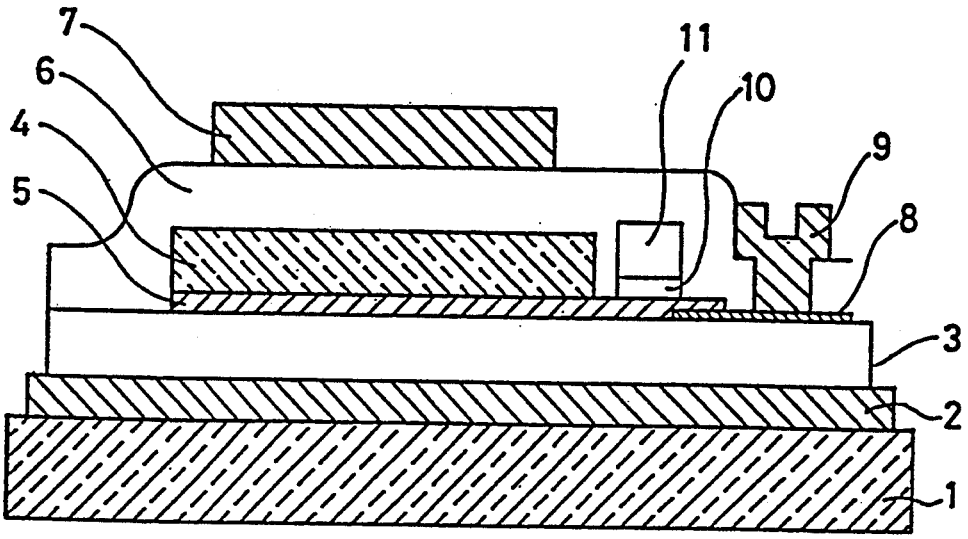
FIG. 6 is a cross-sectional view of a third embodiment of the electroluminescent element according to the present invention.

FIG. 6 is a cross-sectional view showing a third embodiment of the electroluminescent element according to the present invention. The electroluminescent element has a semiconductor layer 5 interposed between the luminescent layer 4 and the first dielectric layer 3, which functions as the drain electrode of the thin-film transistor.

The electroluminescent element with a structure described above has the same function as the electroluminescent element as shown in FIG. 1.

Figure 7:
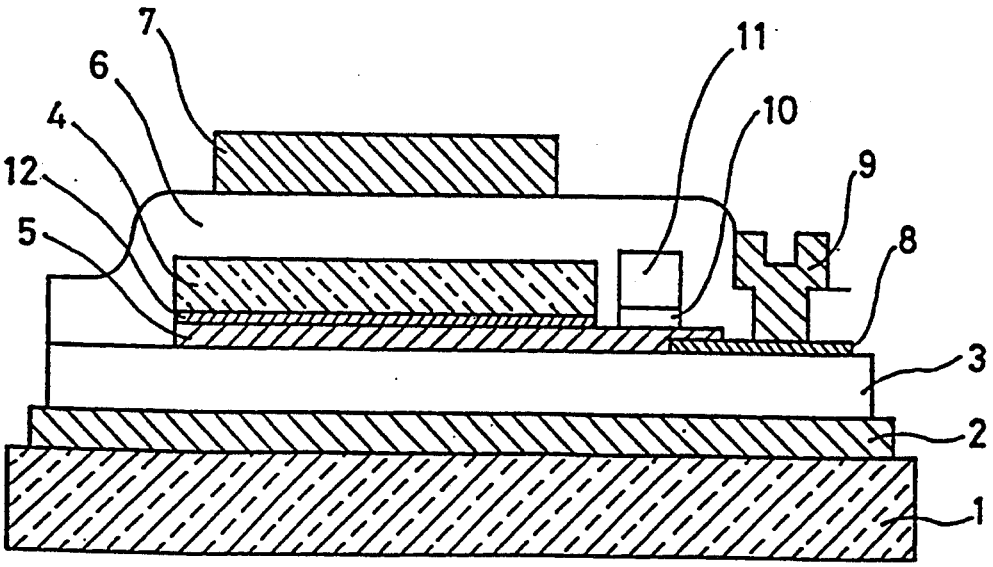
FIG. 7 is a cross-sectional view of a fourth embodiment of the electroluminescent element according to the present invention.

FIG. 7 is a cross-sectional view showing a fourth embodiment of the electroluminescent element according to the present invention. This device has the same structure as the electroluminescent element according to the third embodiment as shown in FIG. 6 except that an insulating layer 12 is interposed between the luminescent layer 4 and the semiconductor layer 5.

Figure 8:
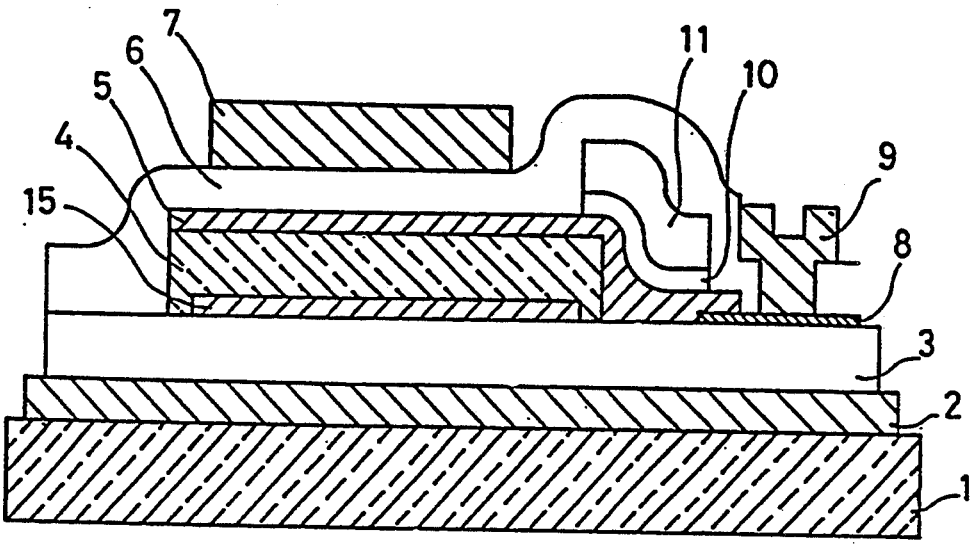
FIG. 8 is a cross-sectional view of a fifth embodiment of the electroluminescent element according to the present invention.

FIG. 8 is a cross-sectional view showing a fifth embodiment of the electroluminescent element according to the present invention having the semiconductor layers 5 and 15 on both sides of the luminescent layer 4. The semiconductor layer 15 formed on the upper side of the luminescent layer 4 acts as the drain electrode.

Figure 9:
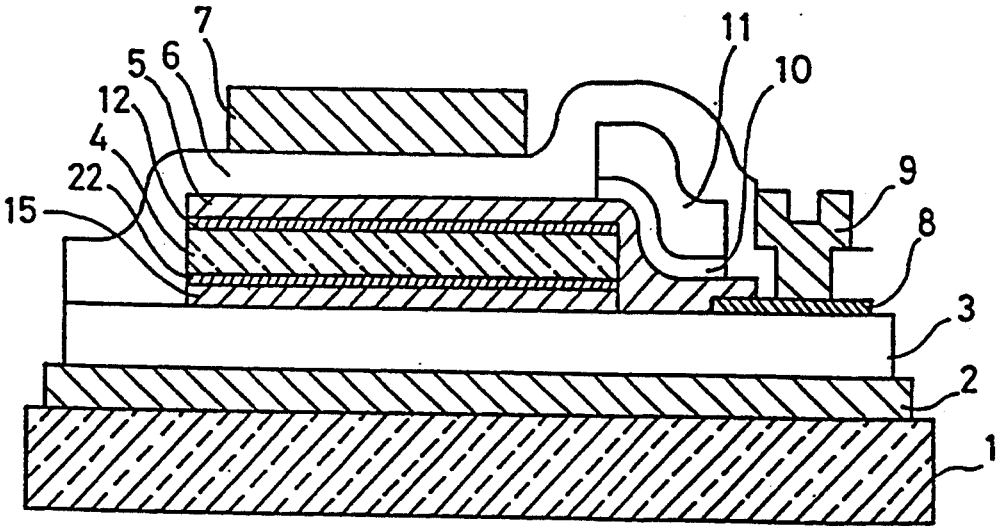
FIG. 9 is a cross-sectional view of a sixth embodiment of the electroluminescent element according to the present invention.

FIG. 9 is a cross-sectional view showing a sixth embodiment of the electroluminescent element according to the present invention wherein insulating layers 12 and 22 are interposed between the luminescent layer 4 and the semiconductor layer 5, and the luminescent layer 4 and the semiconductor layer 15 respectively. Other parts of the structure are the same as the electroluminescent element of the fifth embodiment of the present invention as shown in FIG. 8.

Figure 10:
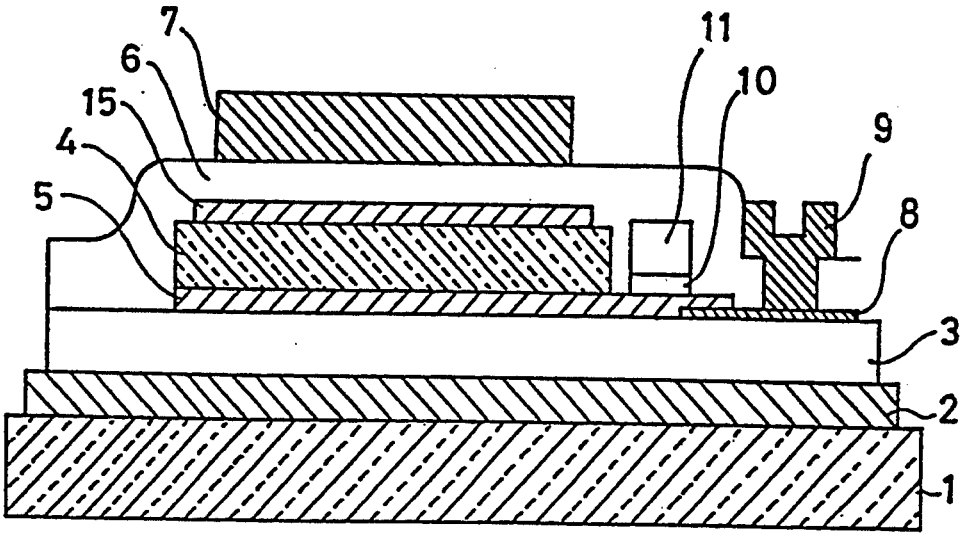
FIG. 10 is a cross-sectional view of a seventh embodiment of the electroluminescent element according to the present invention.

FIG. 10 is a cross-sectional view showing a seventh embodiment of the electroluminescent element according to the present invention having semiconductor layers 5 and 15 on both upper and lower sides of the luminescent layer 4. The semiconductor layer 5 formed on the lower side of the luminescent layer 4 acts as the drain electrode.

Figure 11:
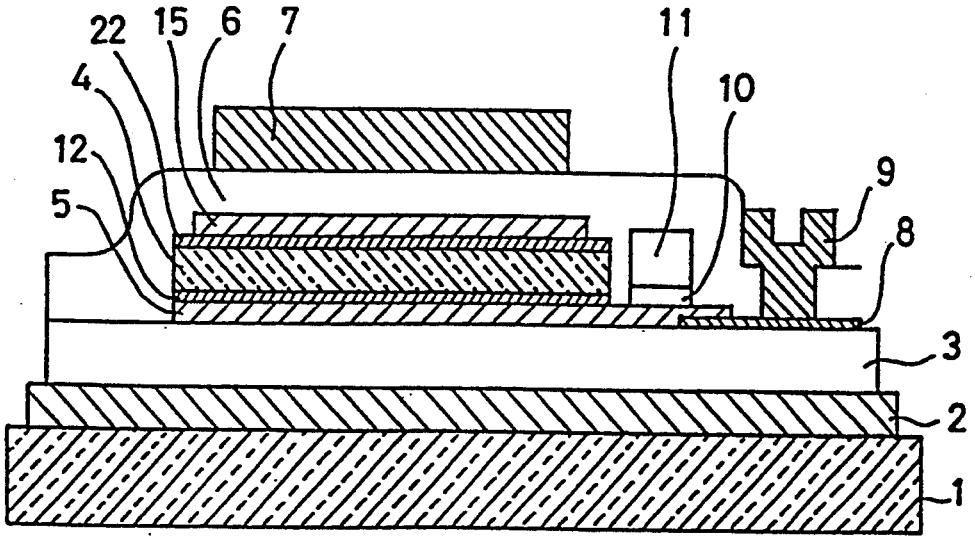
FIG. 11 is a cross-sectional view of an eighth embodiment of the electroluminescent element according to the present invention.
Figure 12:
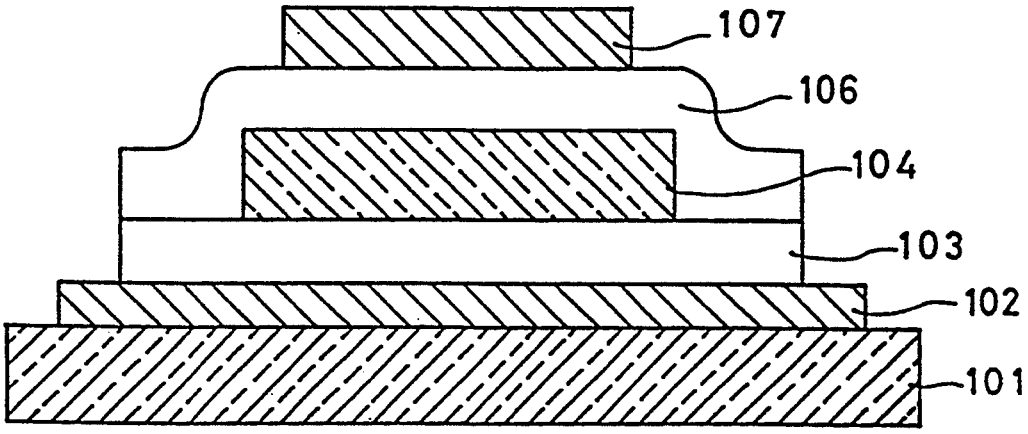
FIG. 12 PRIOR ART
FIG. 12 is a cross-sectional view of a conventional electroluminescent element.

FIG. 11 is a cross-sectional view showing an eighth embodiment of the electroluminescent element according to the present invention. Insulating layers 12 and 22 are interposed between the luminescent layer 4 and the semiconductor layer 5, and the luminescent layer 4 and the semiconductor layer 15, but other parts have the same structure as the electroluminescent element of the seventh embodiment as shown in FIG. 10.

As described above, the electroluminescent element according to the present invention can control the light emission or non-emission of the luminescent layer by the voltage applied to the source electrode and the gate electrode of the thin-film transistor since the element has a semiconductor layer interposed between the luminescent layer and the dielectric layer to function as the drain electrode of the thin-film transistor. Thus the electroluminescent element can control the light emission or non-emission of the luminescent layer with a lower voltage than a conventional electroluminescent element; therefore, expensive driver integrated circuit devices able to withstand high voltage are no longer necessary.

When the electroluminescent elements are arranged in a matrix to form an electroluminescent flat panel display, each electroluminescent element can emit light repeatedly within the frame interval in which all the elements are scanned because the light emission or non-emission is controlled independent of the application of the AC pulse voltage which generates the high electric field in the luminescent layer. Sufficient intensity for the electroluminescent flat panel display can be provided even using red or blue light emitting electroluminescent materials with an intrinsically low intensity of light emission.

The foregoing description of preferred embodiments of the invention has been presented for purpose of illustration and description. It is not intended to be exhaustive or to limit the invention to the precise form disclosed, and modifications and variations are possible in light of the above teachings or may be acquired from practice of the invention. The embodiments are chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electroluminescent element comprising:
a first electrode;
a second electrode;
a luminescent layer located between said first electrode and said second electrode and emitting light by application of an AC voltage to said first electrode and said second electrode;
a first dielectric layer located between said first electrode and said luminescent layer;
a second dielectric layer located between said second electrode and said luminescent layer;
a charge control layer located between said luminescent layer and at least one of said first and second dielectric layers, and controlling the stored charge in accordance with a control voltage; and
a charge control means connected to said charge control layer for controlling charge stored in said charge control layer, said charge control means comprising:
a switching element having an input terminal, an output terminal and a control terminal, and said charge control layer is connected to said output terminal of said switching element.

2. An electroluminescent element comprising:
a first electrode;
a second electrode;
a luminescent layer located between said first electrode and said second electrode and emitting light by application of an AC voltage to said first electrode and said second electrode;
a first dielectric layer located between said first electrode and said luminescent layer;
a second dielectric layer located between said second electrode and said luminescent layer;
a charge control layer located between said luminescent layer and at least one of said first and second dielectric layers, and controlling the stored charge in accordance with a control voltage; and
an insulating layer interposed between said charge control layer and said luminescent layer.

3. An electroluminescent element according to claim 1, further comprising:
a first voltage applying means connected to said input terminal of said switching device; and
a second voltage applying means connected to said control terminal.

4. An electroluminescent element according to claim 1, further comprising:
an AC voltage applying means connected to said first and second electrodes for applying an AC voltage to said first and second electrodes.

5. An electroluminescent element according to claim 3, further comprising:
an AC voltage applying means connected to said first and second electrodes for applying an AC voltage to said first and second electrodes.

6. An electroluminescent element according to claim 5, wherein said AC voltage applying means applies an AC pulse voltage of a threshold value of the light emission of said luminescent layer or less.

7. An electroluminescent element according to claim 6, wherein said first voltage applying means selects a higher or lower voltage than that generated by stored charge in said charge control layer and applies said selected voltage, and said second voltage applying means applies a voltage which controls said switching device.

8. An electroluminescent element according to claim 1, further comprising:
an insulating substrate on which either said first electrode or said second electrode and said switching element is located.

9. An electroluminescent element comprising:
a first electrode;
a second electrode;
a luminescent layer located between said first electrode and said second electrode and emitting light by application of an AC voltage to said first electrode and said second electrode;
a first dielectric layer located between said first electrode and said luminescent layer;
a second dielectric layer located between said second electrode and said luminescent layer; and
a charge control layer located between said luminescent layer and at least one of said first and second dielectric layers, and controlling the stored charge in accordance with a control voltage, and wherein said charge layer control layer comprises a semiconductor material.

10. An electroluminescent element comprising:
an insulating substrate having thereon a lower electrode, a first dielectric layer, a luminescent layer, a second dielectric layer, an upper electrode, a semiconductor layer interposed either (a) between said first dielectric layer and said luminescent layer or (b) between said luminescent layer and said second dielectric layer or (c) both between said first dielectric layer and said luminescent layer and said luminescent layer and said second dielectric layer and a thin-film transistor, wherein said semiconductor layer has a portion extending beyond said luminescent layer which functions as a channel of a thin-film transistor.

* * * * *